US006520697B1

(12) United States Patent
Yamaguchi et al.

(10) Patent No.: US 6,520,697 B1
(45) Date of Patent: Feb. 18, 2003

(54) INK RIBBON CASSETTE

(75) Inventors: Masato Yamaguchi, Kanagawa (JP); Seiichi Morikawa, Kanagawa (JP)

(73) Assignee: Sony Corporation (JP)

( * ) Notice: Subject to any disclaimer, the term of this patent is extended or adjusted under 35 U.S.C. 154(b) by 39 days.

(21) Appl. No.: 09/698,093

(22) Filed: Oct. 30, 2000

(30) Foreign Application Priority Data

Nov. 2, 1999 (JP) ..... 11-312305

(51) Int. Cl.[7] ..... B41J 35/28

(52) U.S. Cl. ..... 400/247; 400/196; 400/208; 400/242.2

(58) Field of Search ..... 400/196, 207, 400/208, 208.1, 242.2, 247, 248, 246

(56) References Cited

U.S. PATENT DOCUMENTS 4,350,452 A * 9/1982 Dials et al. ..... 400/208
5,071,272 A 12/1991 Bell
5,160,204 A * 11/1992 Naito et al. ..... 400/208
5,186,554 A * 2/1993 Mizutani et al. ..... 400/247
5,672,015 A * 9/1997 Lyerly et al. ..... 400/58
6,412,996 B1 * 7/2002 Hamisch ..... 400/693.1

FOREIGN PATENT DOCUMENTS

JP 05-177893 A 10/1993
JP 11-245469 9/1999

OTHER PUBLICATIONS

Abstract of Japanese Patent Publication No. 05177893; dated Jul. 20, 1993.
Abstract of Japanese Patent Publication No. 11245469; dated Sep. 14, 1999.

* cited by examiner

*Primary Examiner*—Andrew H. Hirshfeld
*Assistant Examiner*—Kevin D. Williams
(74) *Attorney, Agent, or Firm*—Rader, Fishman & Grauer PLLC; Ronald P. Kananen, Esq.

(57) ABSTRACT

There is provided an ink ribbon cassette which prevents damage and pollution of a part of an ink ribbon exposed outside of a cassette case housing the ink ribbon. In the ink ribbon cassette in which the part of the ink ribbon housed in the cassette case is exposed outside of the cassette case, a detachably attached cover body for covering the part of the ink ribbon exposed outside of the cassette case is provided.

2 Claims, 6 Drawing Sheets

INK RIBBON CASSETTE

BACKGROUND OF THE INVENTION

1. Field of the Invention

The present invention relates to a novel ink ribbon cassette. Particularly, the present invention relates to a technique for preventing damage and pollution of a part of an ink ribbon exposed outside of a cassette case housing the ink ribbon.

2. Description of the Related Art

FIG. 7 and FIG. 8 show an example of a conventional printer and an ink ribbon cassette.

A printer "a" shown in FIG. 7 and FIG. 8 is a thermal transfer printer, which uses an ink ribbon cassette "b".

In the ink ribbon cassette "b", an ink ribbon "d" is wound in a cassette case "c", and a part of the ink ribbon "d" crosses an opening portion of a recess portion "e" formed in the cassette case "c" to be exposed in the outside.

When the ink ribbon cassette "b" is mounted in the printer "a", a thermal transfer head "f" provided in the printer "a" is relatively inserted in the recess portion "e" of the ink ribbon cassette "b".

When printing is started, a printing paper is pressed to the thermal transfer head "f" through the part of the ink ribbon "d" exposed outside of the cassette case "c", so that ink on the ink ribbon "d" is transferred onto the printing paper by heat of the thermal transfer head "f".

In the foregoing conventional ink ribbon cassette. "b", since the part of the ink ribbon "d" is exposed outside of the cassette case "c", when it is mounted in the printer "a", the part of the ink ribbon "d" exposed outside of the cassette case "c" must be made to pass a narrow gap between the thermal transfer head "f" and a mechanism for pressing the printing paper to the thermal transfer head "f", so that there is a fear that the ink ribbon "d" hitches on the thermal transfer head "f" or a mechanical portion of its periphery and is damaged.

SUMMARY OF THE INVENTION

An object of the present invention is therefore to prevent damage and pollution of a part of an ink ribbon exposed outside of a cassette case housing the ink ribbon.

In order to achieve the above object, an ink ribbon cassette of the present invention includes a detachably attached cover body for covering a part of an ink ribbon exposed outside of a cassette case.

Thus, in the ink ribbon cassette of the present invention, since the part of the ink ribbon exposed outside of the cassette case is covered with the cover body, there is no fear that the ink ribbon is damaged.

DETAILED DESCRIPTION OF THE PREFERRED EMBODIMENTS

Figure 1:
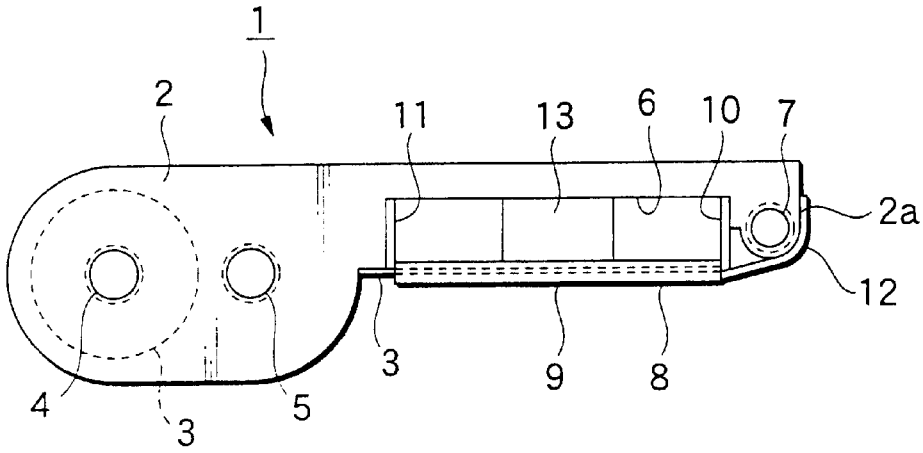
FIG. 1 is a side view, together with FIGS. 2 to 6, showing an ink ribbon cassette of an embodiment of the present invention.

Hereinafter, a preferred embodiment of an ink ribbon cassette of the present invention will be described with reference to the accompanying drawings.

An ink ribbon cassette 1 includes an ink ribbon 3 housed in a cassette case 2. The ink ribbon 3 is wound around a supply spool 4 in a state where its both ends are respectively fixed to the supply spool 4 and a winding spool 5 rotatably disposed in the cassette case 2. A flat recess portion 6 is formed in the cassette case 2, and the ink ribbon 3 is designed to travel along such a path that it goes out of the cassette case 2 from the supply spool 4 through an intermediate spool 7, crosses an opening surface of the recess portion 6, enters the cassette case 2, and is wound around the winding spool 5.

The ink ribbon cassette 1 is provided with a cover body 8. The cover body 8 is formed of a thin metal plate or plastics.

The cover body 8 includes a covering portion 9 having a size almost equal to a size of an opening portion of the recess portion 6 of the cassette case 2. The covering portion 9 is formed of two covering plates 9*a* and 9*b* extremely close to each other and faced to each other in parallel. The cover body 8 includes two side plates 10 and 11, and side edges of the covering plates 9*a* and 9*b* are fixed to lower end portions of the side plates 10 and 11. Further, an outside plate 12 is formed at the front side of the side plate 10 so as to project upward. A piece 13 to be pressed is protrusively provided on the upper surface of the upper covering plate 9*a*.

Figure 2:
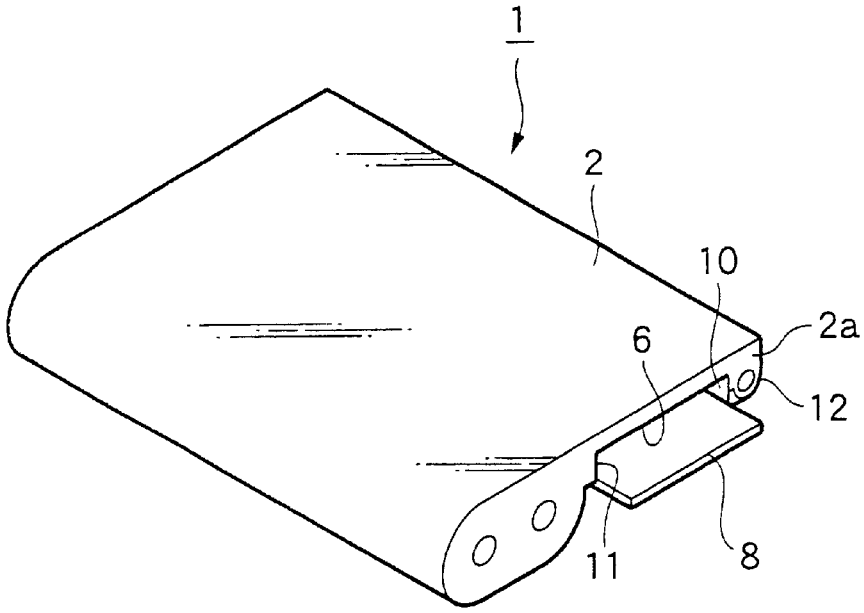
FIG. 2 is a perspective view.
Figure 3:
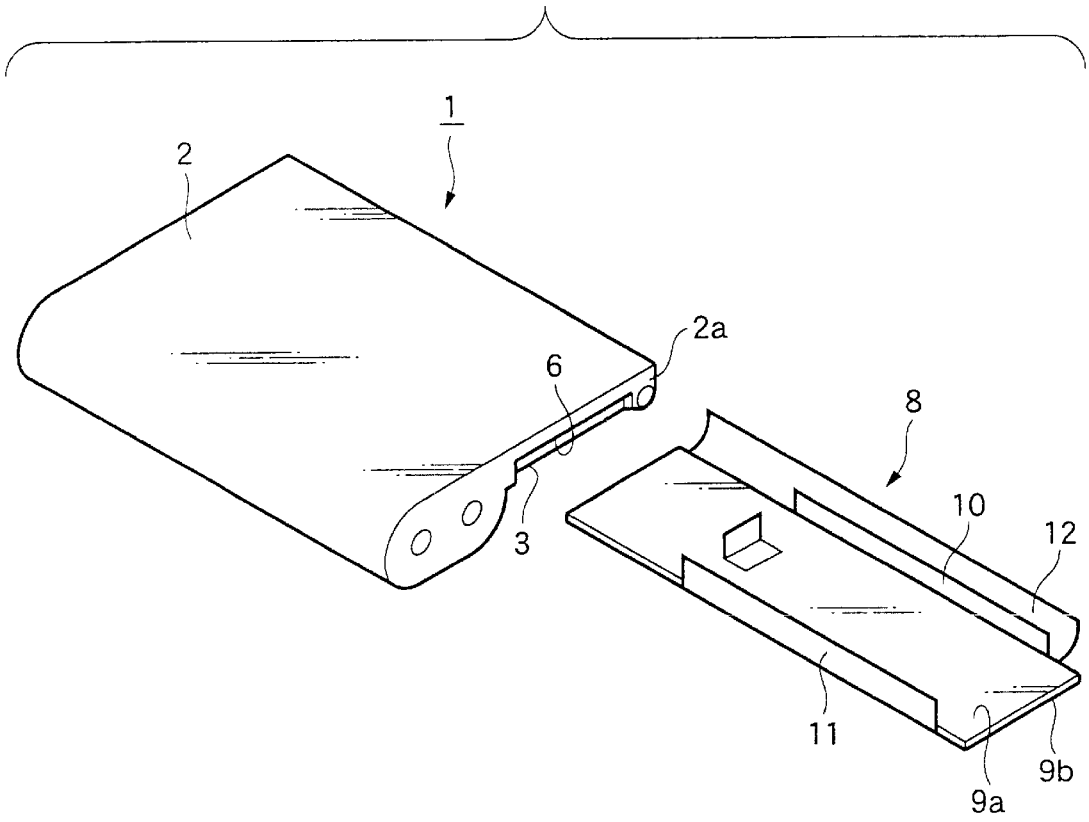
FIG. 3 is a perspective view of a state where a cover body is detached.

Then, the cover body 8 is positioned so that the part of the ink ribbon 3 exposed outside of the cassette case 3 is put between the covering plates 9*a* and 9*b* placed up and down. In this state, the side plates 10 and 11 are elastically in contact with both the front and rear surfaces of the recess portion 6 of the cassette case 2, respectively, and the outside plate 12 is positioned so that a front end portion 2*a* of the cassette case 2 is put between the outside plate and the side plate 10 (see FIG. 1 and FIG. 2).

Mounting of the foregoing ink ribbon cassette 1 into a printer 14 is performed in a manner as described below.

Figure 4:
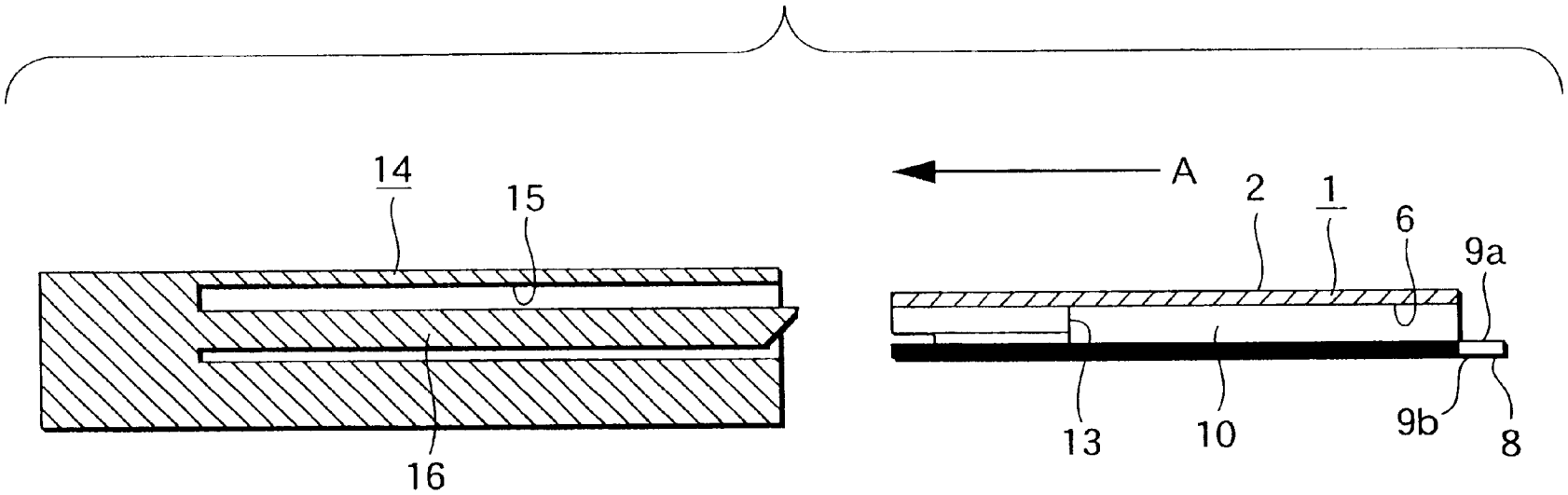
FIG. 4 is a sectional view of a main portion showing a process of mounting to a printer together with FIGS. 5 and 6 and shows a state before the mounting.
Figure 5:
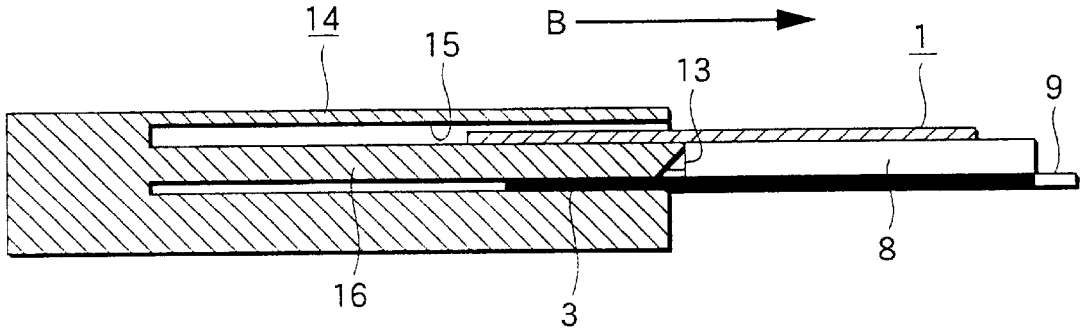
FIG. 5 is a view showing a state in the middle of the mounting.
Figure 6:
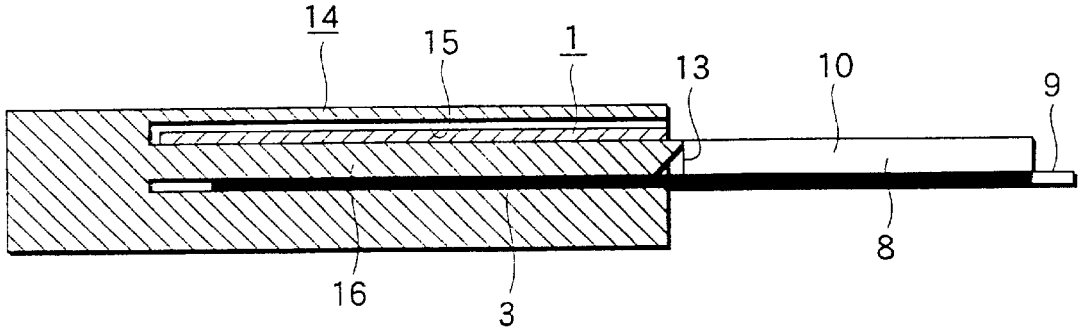
FIG. 6 is a view showing a state where the mounting is completed.
Figure 7:
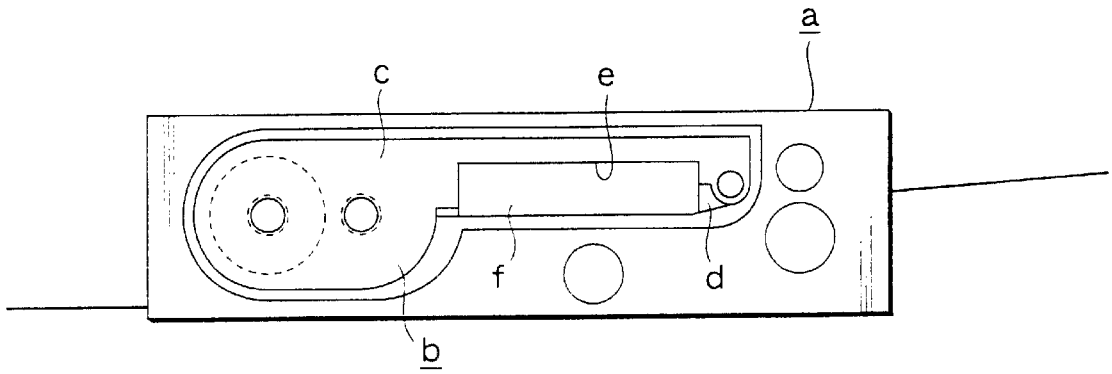
FIG.7 PRIOR ART
FIG. 7, together with FIG. 8, shows a conventional ink ribbon cassette and is a side view showing a state where it is mounted in a printer.
Figure 8:
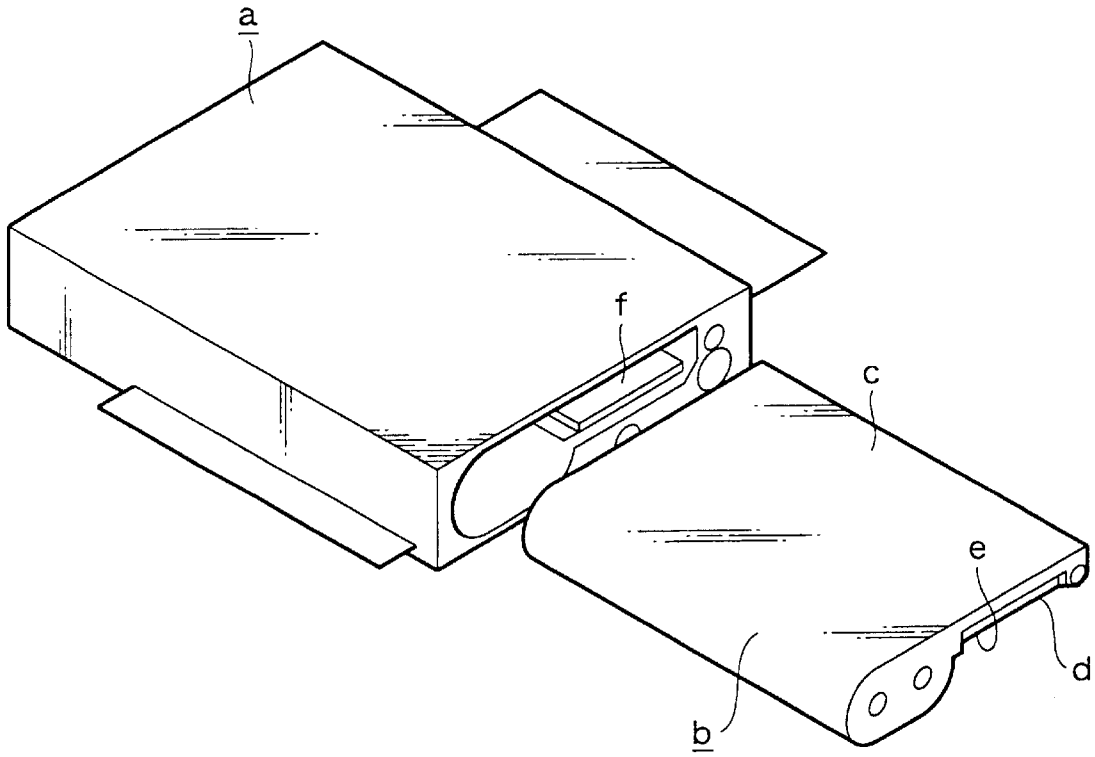
FIG.8 PRIOR ART
FIG. 8 is a perspective view showing the printer and the ink ribbon cassette separately.

When the ink ribbon cassette 1 is inserted into a cassette mounting portion 15 of the printer 14 in the direction of arrow A in FIG. 4 (see FIG. 4 and FIG. 5), a thermal transfer head portion 16 of the printer 14 is relatively inserted into the recess portion 6 of the ink ribbon cassette 1, and the tip end of the thermal transfer head portion 16 comes in contact with the piece 13 to be pressed of the cover body 8 (see FIG. 5). When the ink ribbon cassette 1 is further inserted into the cassette mounting portion 15 from there, the piece 13 to be pressed of the cover body 8 is pressed by the thermal transfer head portion 16 in the direction of arrow B in the drawing, and by this, the cover body 8 is moved relatively to the cassette case 2 in the direction of arrow B in the drawing. When the ink ribbon cassette 1 is completely inserted in the cassette mounting portion 15 of the printer 14 (see FIG. 6), most of the part of the ink ribbon 3 positioned at the opening portion of the recess portion 6 is exposed, and is positioned in the gap between the thermal transfer head portion 16 and the mechanism for pressing the printing paper to the thermal transfer head 16. Then, when a portion of the cover body 8 protruding from the printer 14 is held and is drawn out, the cover body 8 is completely removed from the cassette case 2, and the part of the ink ribbon 3 positioned at the opening portion of the recess portion 6 is completely exposed.

In the foregoing ink ribbon cassette 1, prior to the mounting to the printer 14, since the upper and lower portions of the part of the ink ribbon 3 exposed outside of the cassette case 2 are covered by the covering portion 9 of the cover body 8, when it is mounted in the printer 14, there is no fear that the ink ribbon 3 hitches on the thermal transfer head portion 16 or a mechanical portion of its periphery and is damaged.

Incidentally, in the above embodiment, although the upper and lower portions of the part of the ink ribbon 3 exposed outside of the cassette case 2 are covered, only one of the upper and lower portions may be covered.

Besides, in the above embodiment, although the cover body 8 is held in the cassette case 2 in such a manner that the side plates 10 and 11 are elastically in contact with the sides of the recess portion 6 and the front end portion 2*a* of the cassette case 2 is held between the side plate 10 and the outside plate 12, such modification may be adopted that the covering plates 9*a* and 9*b* slightly hold the part of the ink ribbon 3 exposed outside of the cassette case 2, and by this frictional force, the cover body does not fall away from the state of covering the ink ribbon 3. In the case of doing so, the side plates 10 and 11 and the outside plate 12 become unnecessary.

Further, in the foregoing embodiment, in the process of mounting the ink ribbon cassette 1 into the printer 14, although the piece 13 to be pressed is pressed by the tip end of the thermal transfer head portion 16 so that the cover body 8 deviates from the state where the cover body 8 covers the ink ribbon 3, means for automatically removing the cover body 8 in the process of mounting to the printer 14 is not limited to this sort of means. In the case where means for automatically removing the cover body like this is not included, after the ink ribbon cassette is mounted in the printer, the cover body may be taken off by the hand of the operator.

Incidentally, the shape and structure of each portion shown in the foregoing embodiment is merely an example of materialization performed when the present invention is carried out, and the technical scope of the present invention should not be interpreted restrictedly by these.

As is apparent from the above disclosure, the ink ribbon cassette of the present invention is an ink ribbon cassette in which a part of an ink ribbon housed in a cassette case is exposed outside of the cassette case, and is characterized by comprising a detachably attached cover body for covering the part of the ink ribbon exposed outside of the cassette case.

Thus, in the ink ribbon cassette of the present invention, since the part of the ink ribbon exposed outside of the cassette case is covered with the cover body, there is no fear that the ink ribbon is damaged or polluted.

According to another aspect of the present invention, since the case body includes a covering portion for covering both surfaces of the ink ribbon, the ink ribbon is more certainly protected.

According to still another aspect of the present invention, since the cover body is provided with a portion to be pressed which is pressed by detaching means provided in a printer when the ink ribbon cassette is mounted in the printer so that the case body is detached from the cassette case, the cover body can be easily detached at the mounting to the printer.

What is claimed is:

1. An ink ribbon cassette comprising:

a cassette case;

an ink ribbon housed in the cassette case, a part of the ink ribbon being exposed outside of the cassette case; and a detachably attached cover body for covering the part of the ink ribbon exposed outside of the cassette case, wherein said cover body is provided with a portion to be pressed which is pressed by detaching means provided in a printer when the ink ribbon cassette is mounted in the printer so that said cover body is detached from said cassette case.

2. An ink ribbon cassette comprising:

a cassette case;

an ink ribbon housed in the cassette case, a part of the ink ribbon being exposed outside of the cassette case; and a detachably attached cover body for covering the part of the ink ribbon exposed outside of the cassette case, wherein the cover body is provided with a portion to be pressed which is pressed by detaching means provided in a printer when the ink ribbon cassette is mounted in the printer so that the cover body is detached from the cassette case.

* * * * *

UNITED STATES PATENT AND TRADEMARK OFFICE

CERTIFICATE OF CORRECTION

PATENT NO. : 6,520,697 B1 
DATED : February 18, 2003
INVENTOR(S) : Masato Yamaguchi et al.

It is certified that error appears in the above-identified patent and that said Letters Patent is hereby corrected as shown below:

Column 4,
Line 30, after "case", insert:
-- said cover body including a covering portion for covering both surfaces of the ink ribbon, --.

Signed and Sealed this

Twenty-second Day of March, 2005

JON W. DUDAS
*Director of the United States Patent and Trademark Office*